US011433449B2

(12) United States Patent
Ishihara

(10) Patent No.: US 11,433,449 B2
(45) Date of Patent: Sep. 6, 2022

(54) DRAWING-OUT TOOL FOR SHEET METAL

(71) Applicant: STAR CO., LTD., Gunma-ken (JP)

(72) Inventor: Kosei Ishihara, Gunma-ken (JP)

(73) Assignee: STAR CO., LTD.

( * ) Notice: Subject to any disclaimer, the term of this patent is extended or adjusted under 35 U.S.C. 154(b) by 374 days.

(21) Appl. No.: 16/372,967

(22) Filed: Apr. 2, 2019

(65) Prior Publication Data

US 2019/0308236 A1 Oct. 10, 2019

(51) Int. Cl.

| | |
|---|---|
| ***B21D 31/00*** | (2006.01) |
| ***B21D 11/20*** | (2006.01) |
| ***B21D 11/22*** | (2006.01) |
| ***B21D 22/20*** | (2006.01) |
| ***B21D 35/00*** | (2006.01) |
| ***B21D 53/36*** | (2006.01) |
| ***B21D 1/06*** | (2006.01) |
| ***B21D 1/12*** | (2006.01) |
| ***B21D 1/08*** | (2006.01) |

(52) U.S. Cl.

CPC ..... *B21D 31/005* (2013.01); *B21D 1/06* (2013.01); *B21D 1/08* (2013.01); *B21D 1/12* (2013.01); *B21D 11/20* (2013.01); *B21D 11/22* (2013.01); *B21D 22/20* (2013.01); *B21D 35/002* (2013.01); *B21D 53/36* (2013.01)

(58) Field of Classification Search

CPC ..... B21D 1/06; B21D 1/08; B21D 1/12

USPC ..... 72/155

See application file for complete search history.

(56) References Cited

U.S. PATENT DOCUMENTS

| | | | | |
|---|---|---|---|---|
| 2,908,803 | A | 10/1959 | Williams et al. | |
| 4,930,335 | A | 6/1990 | Ishihara | |
| 5,333,486 | A | 8/1994 | Ishihara | |
| 5,477,027 | A * | 12/1995 | Biro | B23K 3/0315 219/235 |
| 5,479,804 | A | 1/1996 | Cook | |
| 5,943,902 | A | 8/1999 | Ishihara | |
| 6,679,092 | B2 | 1/2004 | Irii | |

(Continued)

FOREIGN PATENT DOCUMENTS

| | | |
|---|---|---|
| CN | 102527775 | 7/2012 |
| CN | 203649054 | 6/2014 |

(Continued)

OTHER PUBLICATIONS

European Search Report from Corresponding European Patent Application 19165695.8, dated Sep. 12, 2019.

*Primary Examiner* — Jessica Cahill

*Assistant Examiner* — Smith Oberto Bapthelus

(57) ABSTRACT

To provide a drawing-out tool for sheet metal which is less in failure and excellent in the durability and has excellent handling property by evading generation of trouble in an electric system by shielding dust, metal dust, soil dust or the like from mingling in or attaching to the electric system. The drawing-out tool for sheet metal comprises a center shaft (22); a first operation means (20) provided with a bit (25) arranged to an apex part of the center shaft; a second operation means (30) for pulling-up the first operation means; and an energization mechanism (100) for supplying electric current to the bit are provided. The housing (10) for accommodating the illumination unit (70) and the illumination unit for illuminating a sheet metal surface accommodated in the housing are included.

10 Claims, 20 Drawing Sheets

(56) References Cited

U.S. PATENT DOCUMENTS

| | | | | |
|---|---|---|---|---|
| 9,162,315 | B2 | 10/2015 | Ishihara | |
| 2003/0097869 | A1* | 5/2003 | Meichtry | B21D 1/06 72/705 |
| 2014/0198486 | A1 | 7/2014 | Hirschburger | |
| 2015/0251299 | A1 | 9/2015 | Fu et al. | |
| 2018/0111213 | A1* | 4/2018 | Mantes | B23K 3/0346 |

FOREIGN PATENT DOCUMENTS

| | | | |
|---|---|---|---|
| CN | 205587463 | | 9/2016 |
| CN | 205967782 | | 2/2017 |
| CN | 107552599 | | 1/2018 |
| EP | 0603155 | | 12/1993 |
| EP | 2439011 | | 4/2012 |
| JP | H07-303920 | A | 11/1995 |
| JP | 2876402 | | 1/1999 |
| JP | 2003/211374 | | 7/2003 |
| JP | 2007/313556 | | 12/2007 |
| JP | 2009/095867 | | 5/2009 |
| JP | 2012/081517 | | 4/2012 |
| JP | 5716889 | | 3/2015 |

* cited by examiner

DRAWING-OUT TOOL FOR SHEET METAL

CROSS REFERENCE TO THE RELATED APPLICATIONS

This application is based on and claims priority to Japanese patent application No. 2018-84530, filed Apr. 8, 2018, the entire disclosure of which is herein incorporated by reference as a part of this application and to Japanese patent application No. 2018-145443, filed Jul. 13, 2018, the entire disclosure of which is herein incorporated by reference as a part of this application.

BACKGROUND OF THE INVENTION

The present invention relates to a drawing-out tool for sheet metal for drawing-out a recess part on a sheet metal surface during sheet metal process.

So far, as a drawing-out tool for sheet metal for drawing-out a recess part on a sheet metal surface during sheet metal process, a drawing-out tool for sheet metal for drawing-out while applying a fine force to an apex of a bit for welding on the sheet metal surface has been proposed by the present inventors (JP 5716889 B1).

A drawing-out tool for sheet metal shown in JP 5716889 B1 includes: a center shaft; a first operation means arranged to an apex part of the center shaft and provided with a bit weldable to a sheet metal surface; a second operation means for pulling-up the first operation means; a support member for supporting the first operation means; an energization mechanism for supplying electric current to the bit; a leg body for supporting the second operation means; and a power source cord for supplying electricity to the energization mechanism, and is used by connecting the other end side of the power source cord to a welder, and makes it possible to perform a series of sheet metal operations such as supplying electric current to the bit, welding the apex of the bit to a sheet metal correction front surface to pull up a recess part of the sheet metal correction surface, furthermore, after pulling-up of the recess part, releasing the welding of the bit.

Now, in a sheet metal working field that uses a drawing-out tool for sheet metal, dust, metal dust, soil dust and the like are present abundantly. Therefore, the followings are required, that is, (1) dust, metal dust, soil dust and the like do not mingle in or attach to an energization mechanism for supplying electric current to the bit, and (2) a trouble such as contact failure is not generated in an electric system.

Furthermore, the working field of the sheet metal process is generally not guaranteed with sufficient lighting, therefore, in order to make it possible to perform the sheet metal process efficiently in a short time even in a dark working field, at least, (1) sufficient lighting is secured during the sheet metal process, and (2) an operator can visually clearly observe unevenness of a sheet metal surface are desired from the viewpoint of an operation environment are desired.

In this point, a drawing-out tool for sheet metal shown in JP 5716889 B1 is not necessarily sufficient in protection of an electric system of an energization mechanism for supplying electric current to a bit, furthermore, the drawing-out tool for sheet metal itself is not provided with a means for illuminating a sheet metal surface. Therefore, there are risks such that (1) a trouble is generated when dust, metal dust, and soil dust mingle in or attach to an electric system of an energization mechanism for supplying electric current to the bit (for example, a contact failure that is generated when dust, metal dust, and soil dust mingle in from a first throughhole formed in the energization mechanism to make the dust, metal dust, and soil dust attach to a contact part between a center shaft inserted into the first throughhole and an energization chip that is a constituent member of the energization mechanism), (2) when a working field is poorly illuminated, the irregularity on a surface of the sheet metal is difficult to see to be incapable of efficiently performing the sheet metal process, and (3) when an external illumination means is provided, even when a sheet metal surface is illuminated, for example, from an oblique front direction, a shadow due to the center shaft or the bit tends to be generated on the sheet metal surface (see, for example, FIG. 23), in particular, in the case where the shadow overlaps with the irregularity on the sheet metal surface, there is a risk such that a small relief on the sheet metal surface becomes difficult to see to be difficult to perform the sheet metal process smoothly to cause a bad influence on the sheet metal process (see, for example, FIG. 24) or the like.

SUMMARY OF THE INVENTION

Accordingly, an object of the present invention is to provide a drawing-out tool for sheet metal that is less in failure and excellent in the durability and has excellent handling property by shielding dust, metal dust, soil dust and the like from mingling in and attaching to an electric system, and by evading a trouble from occurring in an electric system.

Another object of the present invention is to provide a drawing-out tool for sheet metal which can secure sufficient brightness during a sheet metal process, can clearly see a relief on a sheet metal surface in the neighborhood of the bit necessary to be subjected to sheet metal process, and can efficiently perform the sheet metal process while illuminating irregular parts necessary to be subjected to the sheet metal process even when the working field is poorly illuminated.

Still another object of the present invention is to provide a drawing-out tool for sheet metal which can evade generation of a shadow due to the center shaft or the bit on a sheet metal part even when the sheet metal surface is illuminated, can secure brightness sufficient for performing the sheet metal process, and can perform the sheet metal process while illuminating the neighborhood of the welded bit in a state where the shadow is not present.

Further still another object of the present invention is to provide a drawing-out tool for sheet metal which constitutes a compact illumination unit by integrating illumination members in a housing, can freely control an amount of light and can accurately illuminate a place necessary to be subjected to the sheet metal process.

Advantages of the Invention

According to the present invention, the following advantages may be obtained.

(1) By forming a space (first space) and a power source accommodating space (second space) partitioned by the space and division walls in a housing, and by accommodating, in the first space, an energization part body of an energization mechanism, on the other hand, by accommodating a power source for light source in the second space, and by shielding the dust, metal dust, and soil dust from mingling in and attaching to the electric system to evade the generation of the trouble to the electric system, a drawing-out tool for sheet metal that is less in the failure and excellent in the durability, and has excellent handling property may be obtained.

(2) A drawing-out tool for sheet metal which may secure sufficient brightness during the sheet metal process, may clearly grasp the relief on the sheet metal surface in the neighborhood of a bit necessary to be subjected to the sheet metal process, and may efficiently perform the sheet metal process by illuminating a sheet metal place necessary to be subjected to the sheet metal process even when the working field is poorly illuminated may be obtained.

(3) A drawing-out tool for sheet metal which may evade generation of a shadow due to the center shaft or bit even when a sheet metal surface is illuminated, may secure the brightness sufficient when performing the sheet metal process, and may perform the sheet metal process by illuminating the neighborhood of a welded bit in a state where a shadow is not present is obtained.

(4) A drawing-out tool for sheet metal which may be compactly constituted by integrating illumination members constituting an illumination unit in a housing and may accurately illuminate a position necessary to be subjected to the sheet metal process by freely adjusting an amount of light is obtained.

BRIEF DESCRIPTION OF THE DRAWINGS

FIG. 13 is a schematic view showing a wiring to the LED light sources or the like;

FIG. 21 is a perspective view showing a state where an illumination unit of the drawing-out tool for sheet metal shown in FIG. 1 is turned on;

DETAILED DESCRIPTION OF THE PREFERRED EMBODIMENT

Figure 1:
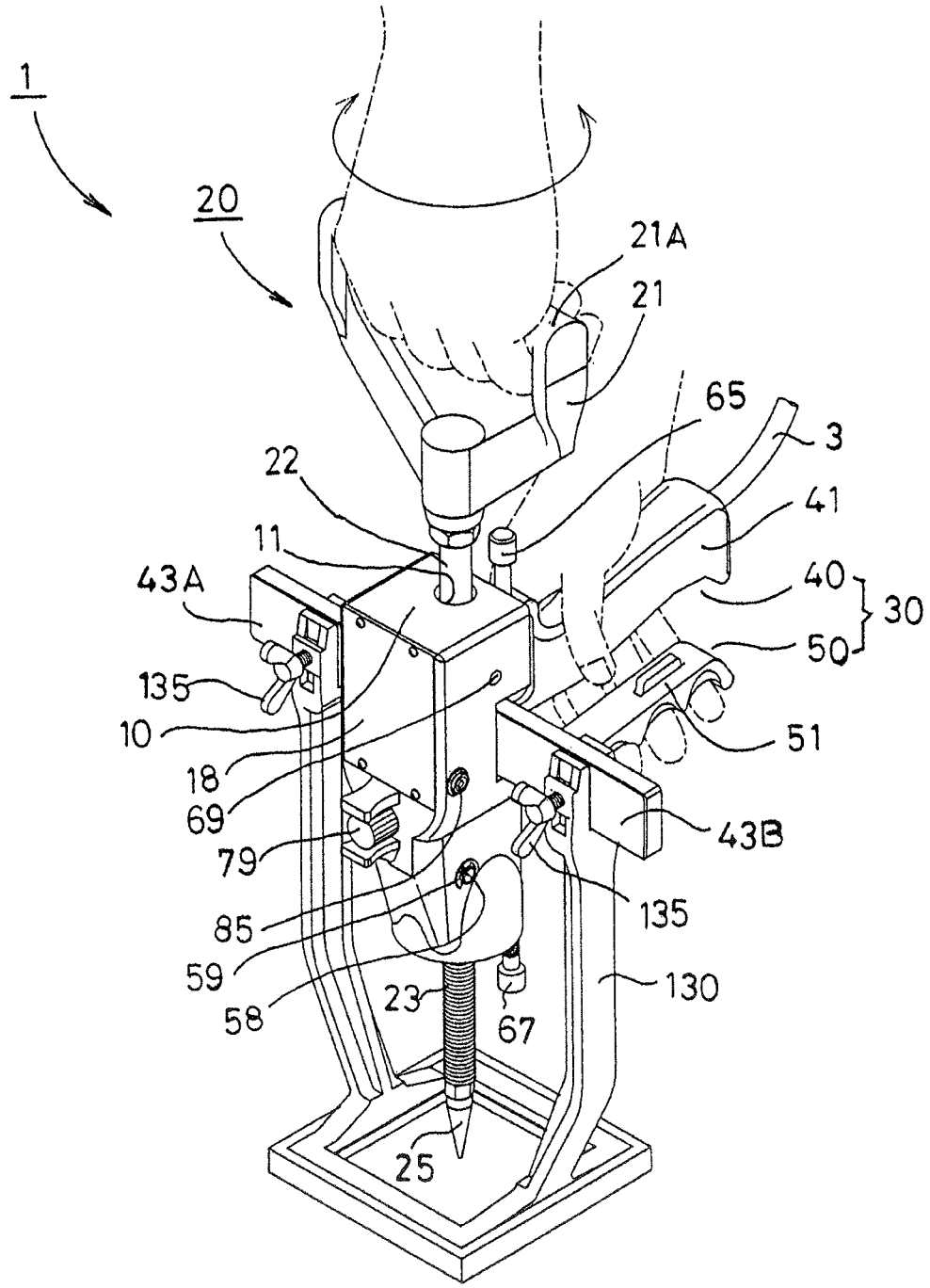
FIG. 1 is a perspective view of a drawing-out tool for sheet metal relating to the present invention, and a perspective view showing a left hand grasping a handle constituting a first operation means and a right hand grasping a second operation means by a virtual line (dashed dotted line)
Figure 2:
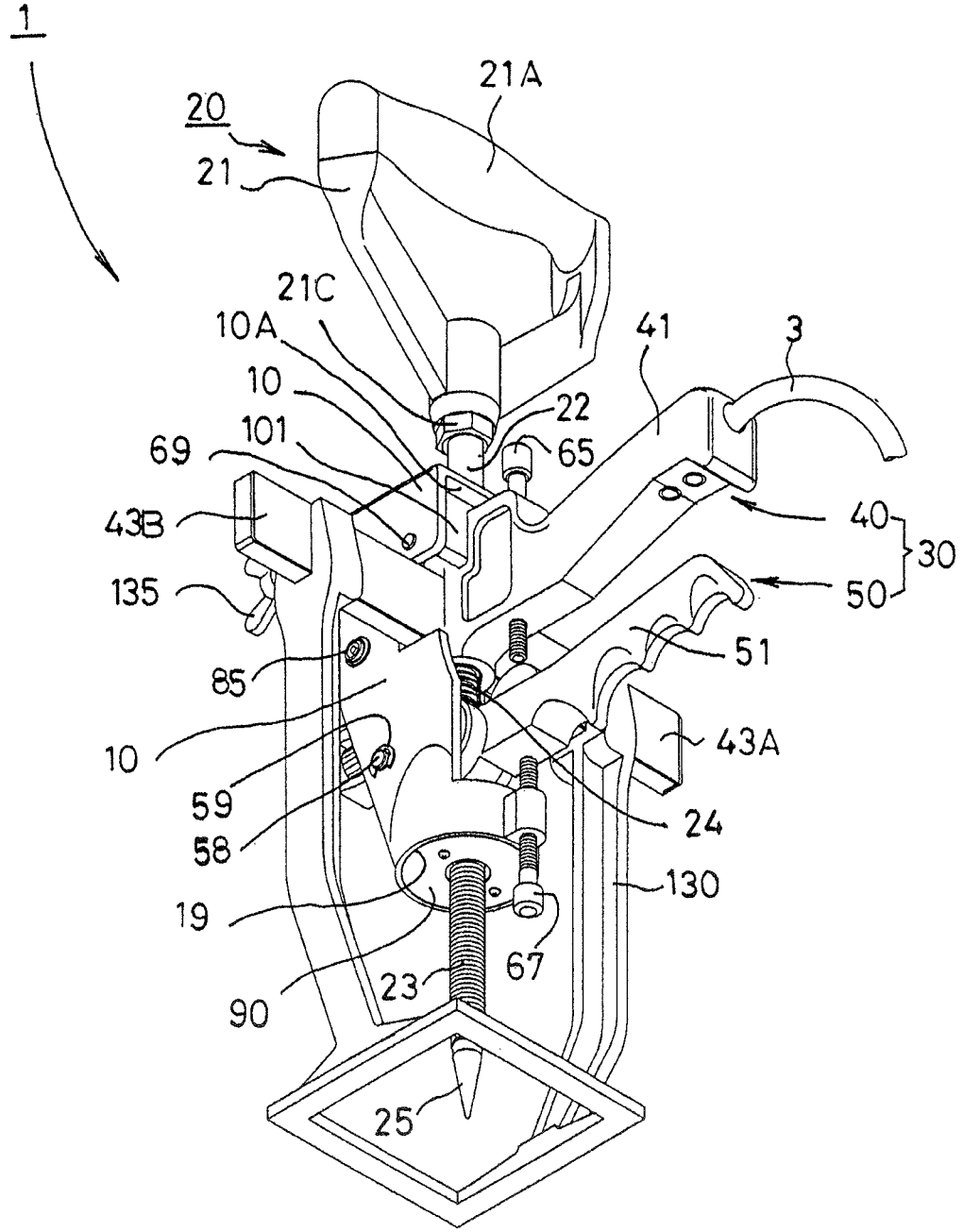
FIG. 2 is a perspective view obtained by seeing up a back surface of the drawing-out tool for sheet metal shown in FIG. 1 from a bottom surface side.
Figure 3:
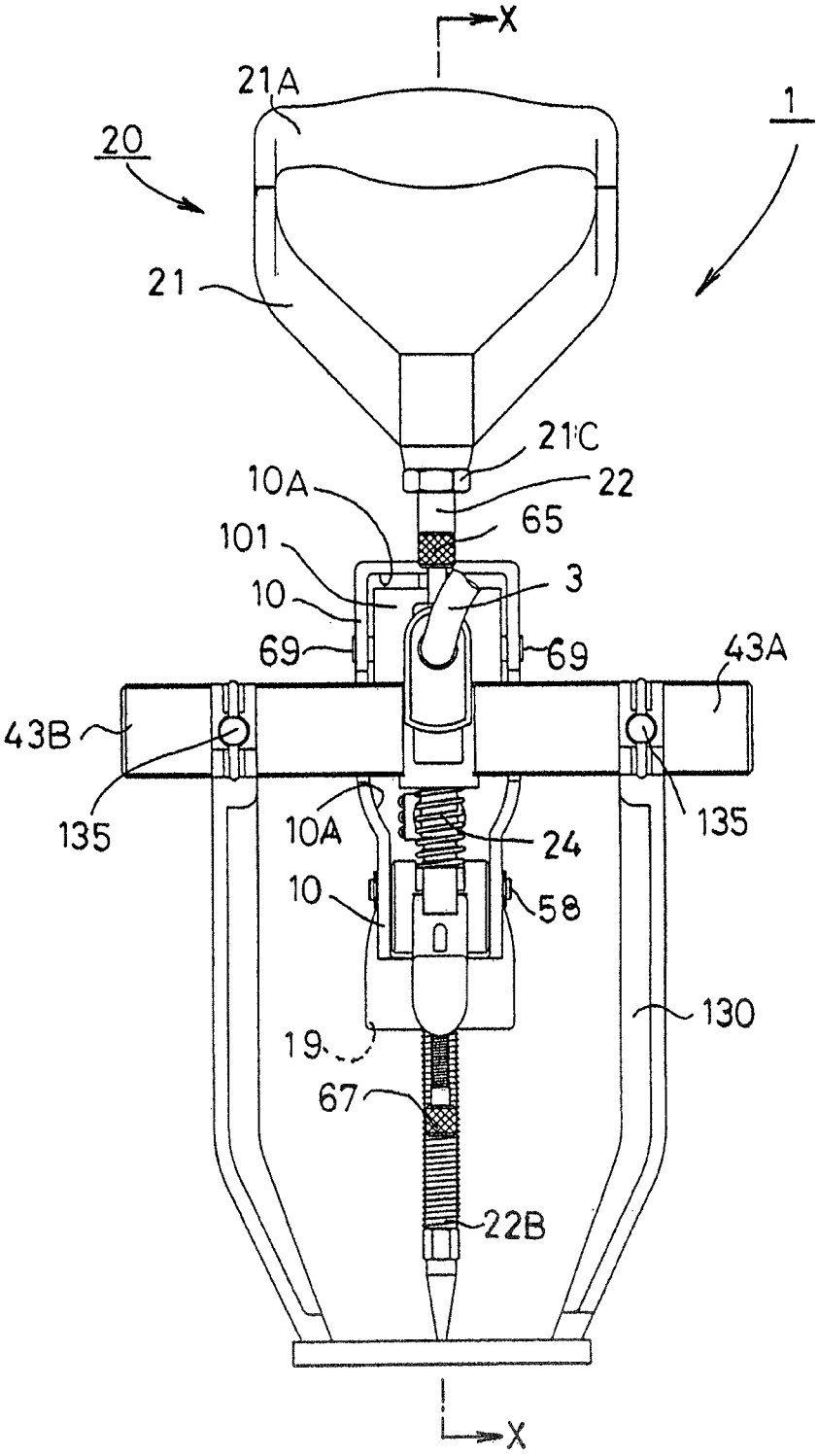
FIG. 3 is a back view of the drawing-out tool for sheet metal shown in FIG. 1.
Figure 4:
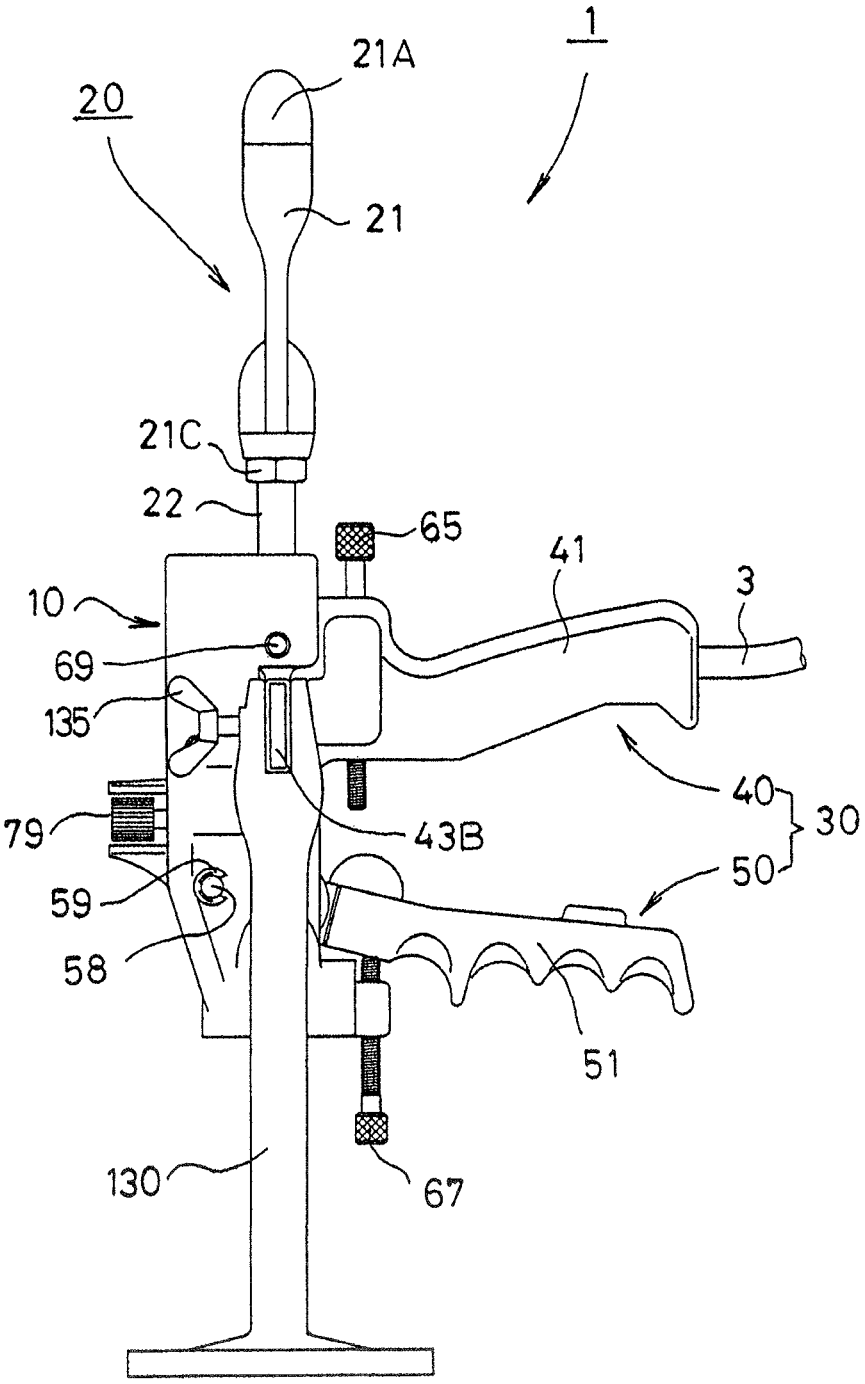
FIG. 4 is a right side view of the drawing-out tool for sheet metal shown in FIG. 1.
Figure 5:
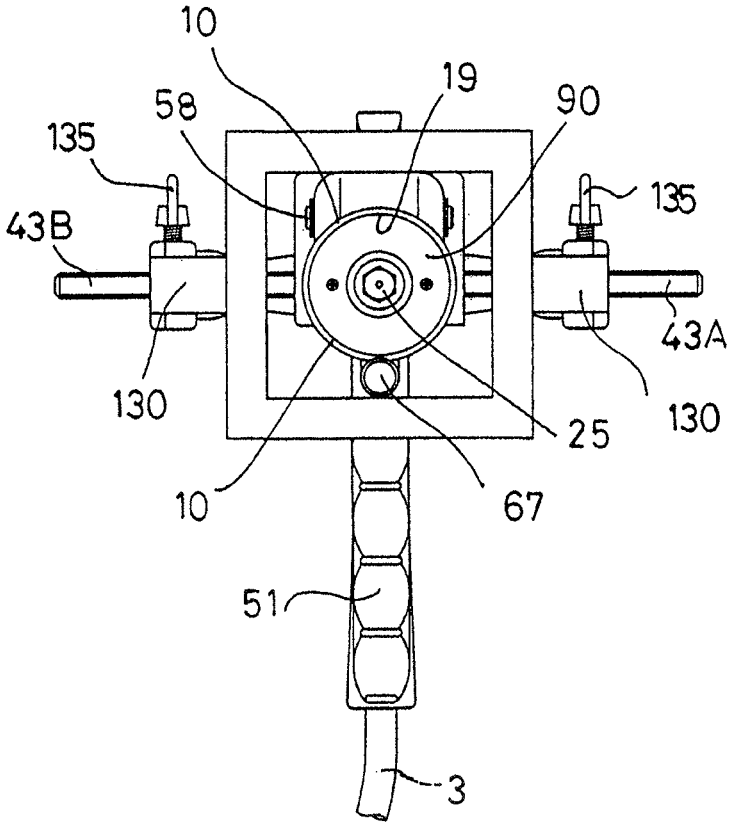
FIG. 5 is a bottom view of the drawing-out tool for sheet metal shown in FIG. 1.

A drawing-out tool for sheet metal according to the present invention includes: a center shaft; a first operation means provided with a bit arranged to an apex part of the center shaft and weldable to a sheet metal surface; a second operation means for pulling-up the first operation means; an energization mechanism for supplying electric current to the bit; and a leg body for supporting the second operation means, wherein a housing for accommodating an illumination unit and the illumination unit for illuminating the sheet metal surface accommodated in the housing are provided.

The housing preferably includes: a space for accommodating the energization mechanism; and a power source accommodating part for accommodating a power source for a light source constituting the illumination unit.

The illumination unit preferably includes: a light source incorporated in the housing; a power source for the light source for supplying electric power to the light source; and a light diffusion plate for diffusing light supplied from the light source, wherein the light source is fixed on a printed circuit board; and the printed circuit board and the light diffusion plate are preferably arranged correspondingly isolated.

A drawing-out tool for sheet metal according to the present invention is also made into a drawing-out tool for sheet metal including: a center shaft; a first operation means provided with a bit arranged to an apex part of the center shaft and weldable to a sheet metal surface; a second operation means for pulling-up the first operation means; an energization mechanism for supplying electric current to the bit; and a leg body for supporting the second operation means, wherein a housing for accommodating an illumination unit and the illumination unit for illuminating the sheet metal surface accommodated in the housing are provided; wherein the housing includes a space for accommodating the energization mechanism, and a power source accommodating part for accommodating a power source for a light source constituting the illumination unit; wherein the illumination unit includes a light source incorporated in the housing, the power source for a light source for supplying electric power to the light source, and a light diffusion plate for a diffusing light supplied from the light source; wherein the light source is fixed on a printed circuit board, and the printed circuit board and the light diffusion plate are arranged correspondingly isolated; wherein diffused light obtained by making light supplied from the light source pass the light diffusion plate is made possible to be supplied as diffused light for illuminating a limited area in the neighborhood of the bit.

Furthermore, a drawing-out tool for sheet metal according to the present invention is also made into a drawing-out tool for sheet metal including: a center shaft; a first operation means provided with a bit arranged to an apex part of the center shaft and weldable to a sheet metal surface; a second operation means for pulling-up the first operation means; a support member for supporting the first operation means; an energization mechanism for supplying electric current to the bit; and a leg body for supporting the second operation means, wherein a housing for accommodating an illumination unit and the illumination unit for illuminating the sheet metal surface accommodated in the housing are provided; wherein the housing includes a space for accommodating the energization mechanism, and a power source accommodating part for accommodating a power source for a light source for constituting the illumination unit; wherein the illumination unit includes a light source incorporated in the housing, the power source for a light source for supplying electric power to the light source, and a light diffusion plate for a diffusing light supplied from the light source; wherein the light source is fixed on a printed circuit board, and the printed circuit board and the light diffusion plate are arranged correspondingly isolated; and wherein diffused light obtained by making light supplied from the light source pass the light diffusion plate is made possible to be supplied as diffused light that does not generate a shadow in a limited area in the neighborhood of the bit.

Still furthermore, a drawing-out tool for sheet metal according to the present invention is also made into a drawing-out tool for sheet metal including: a center shaft; a first operation means provided with a bit arranged to an apex part of the center shaft and weldable to a sheet metal surface; a second operation means for pulling-up the first operation means; a support member for supporting the first operation means; an energization mechanism for supplying electric current to the bit; a leg body for supporting the second operation means; and a power cord for supplying electricity to the energization mechanism, wherein a housing for accommodating an illumination unit and the illumination unit for illuminating the sheet metal surface accommodated in the housing are provided; wherein the housing includes a space for accommodating the energization mechanism, and a power source accommodating part for accommodating a power source for a light source for constituting the illumination unit; wherein the illumination unit includes a light source incorporated in the housing, the power source for a light source for supplying electric power to the light source, and a light diffusion plate for a diffusing light supplied from the light source; wherein the light source is fixed on a printed circuit board, and the printed circuit board and the light diffusion plate are arranged corresponding isolated; and wherein diffused light obtained by making light supplied from the light source pass the light diffusion plate is made possible to be illuminated on a sheet metal surface in the neighborhood of the bit, and the diffused light is made possible to be supplied as the diffused light that does not generate the shadow due to the center shaft and the bit in a limited small area in the neighborhood of the bit.

It is preferable to form division walls in the housing to partition the space and the power source accommodating part by the division walls.

The power source accommodating part has an opening part that makes it possible to insert and release the power source for light source and the opening part is clogged with a cover member.

It is preferable to accommodate a base end part of the second operation means in the space of the housing.

It is preferable to constitute the light source from LED light sources, the LED light sources are fixed on the printed circuit board arranged in the housing, and a plurality of the LED light sources are arranged spaced equidistant apart on the printed circuit board to form an LED light source group.

The illumination unit may be formed such that an illuminance adjusting volume part is provided, and a light amount of the LED light source is adjustable by the illuminance adjusting volume part.

It is preferable that the housing is supported by the second operation means supported by the leg body.

The housing may be formed such that the space for accommodating the energization part body, a first insertion hole through which the center shaft is inserted, a second insertion hole through which a supporting screw for supporting the housing is inserted, a third insertion hole through which a support shaft for supporting a second lever constituting the second operation means is inserted, a throughhole for exposing one end of the illuminance adjusting volume part, the power source accommodating part, and a step part for accommodating the light diffusion plate and directed downward are provided.

The second operation means includes a pair of arms extended right and left, the arm and the energization part body are integrally formed, the arms are supported by the leg body, in a state where the energization part body is housed in the space of the housing, an apex of a supporting screw inserted in the second insertion hole formed in the housing screws with a screw hole formed in the energization part body, in this state, the other end of the supporting screw stays in the second insertion hole, and the housing may be formed so as to be supported by the energization part body.

In what follows, an example relating to the present invention will be described together with a drawing-out tool for sheet metal constituted by accommodating an energization part body of an energization mechanism in a housing and by incorporating an illumination unit in the housing with reference to the drawings. Here, an example where a light emitting diode (LED) is used as a light source, and a charge type battery is used as a power source for light source is shown.

Illumination Unit 70:

In FIG. 1 to FIG. 17, an illumination unit 70 illuminates a sheet metal surface and is accommodated in a housing 10.

The illumination unit 70 includes an illumination part body 71 and a light diffusion plate 90. Among these, the illumination part body 71 includes an LED light source 74 incorporated in the housing 10 and a battery 80 for supplying electric power to the LED light source. The printed circuit board 72 on which the LED light source is fixed and the light diffusion plate 90 are arranged correspondingly isolated in the housing.

The illumination unit 70 includes an illuminance adjusting volume part 78 and a light amount of the LED light source 74 may be adjusted by the illuminance adjusting volume part.

Figure 11:
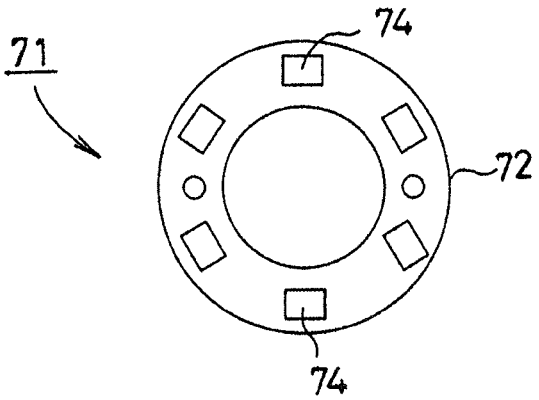
FIG. 11 is a back view of the printed circuit board in which the LED light sources or the like are embedded.
Figure 12:
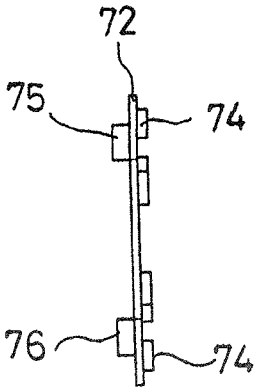
FIG. 12 is a right side view of FIG. 10.
Figure 13:
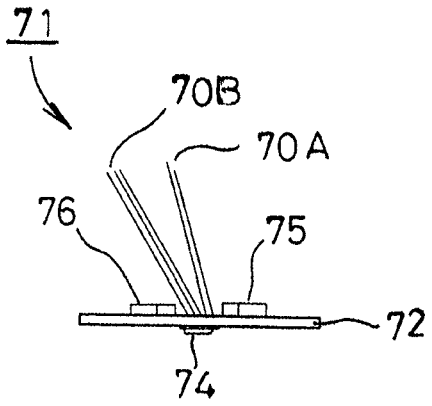
Figure 14:
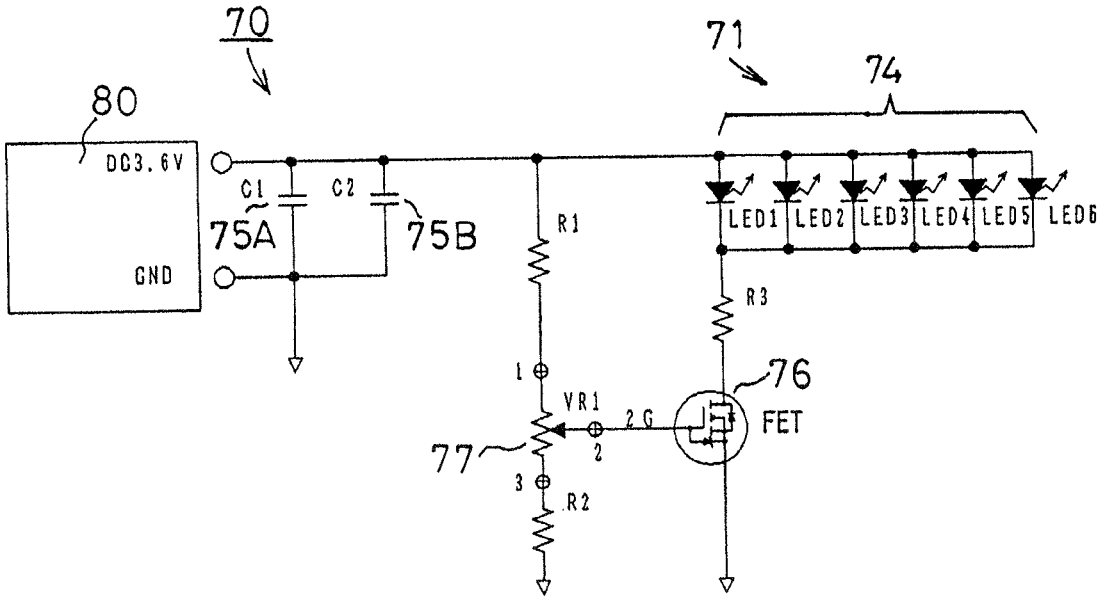
FIG. 14 is a circuit diagram of an illumination part that constitutes an illumination unit and is provided with an LED light source.
Figure 15:
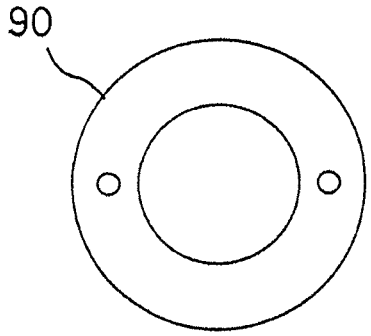
FIG. 15 is a front view of a light diffusion plate.
Figure 16:
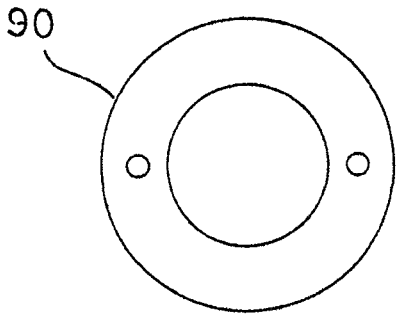
FIG. 16 is a back view of the light diffusion plate.
Figure 17:
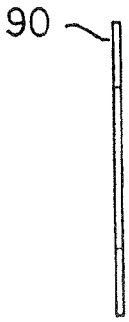
FIG. 17 is a right side view of FIG. 15.
Figure 18:
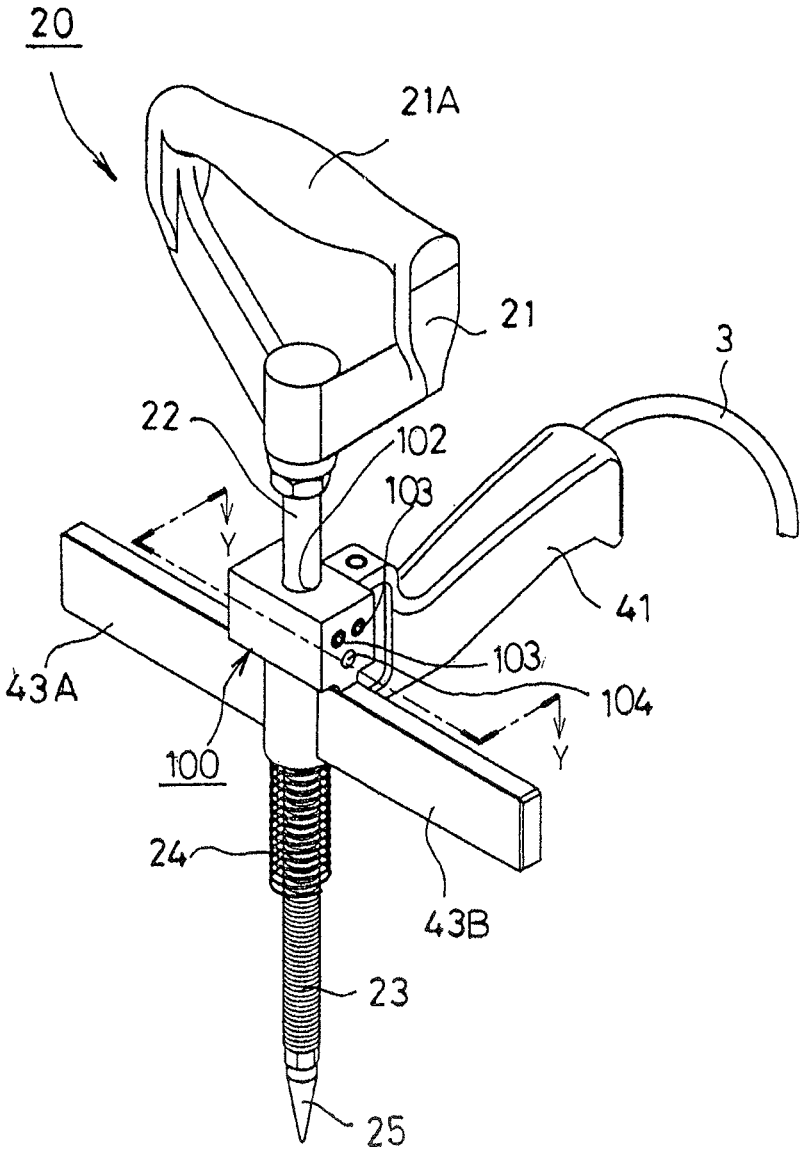
FIG. 18 is a perspective view showing an essential part of the drawing-out tool for sheet metal in which an energization mechanism is incorporated.
Figure 19:
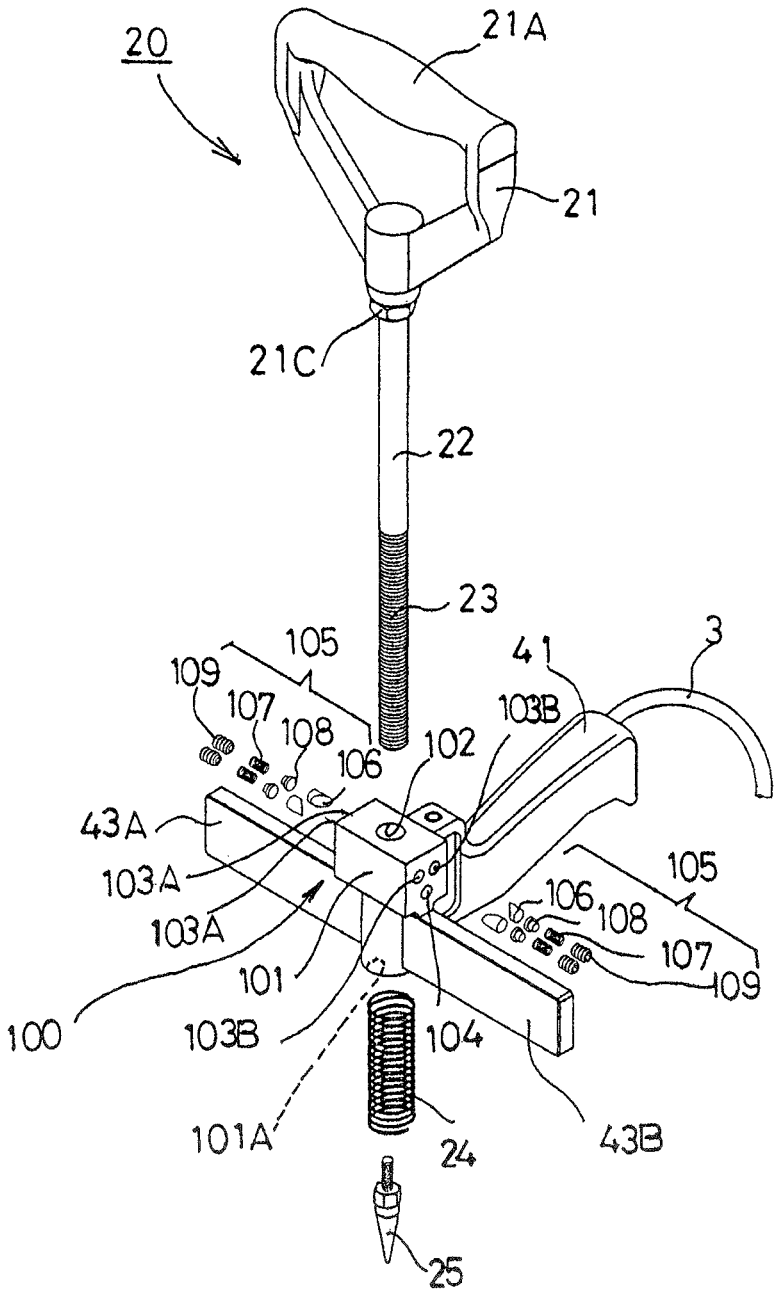
FIG. 19 is an exploded perspective view showing an essential part of the drawing-out tool for sheet metal in which the energization mechanism is incorporated and showing by exploding constituent components of the energization mechanism.

The LED light source 74 is constituted of 6 LED light sources, the LED light sources are connected in parallel and arranged spaced equidistant apart in a circumference direction of the printed circuit board 72 arranged in the housing (see FIG. 11, FIG. 14). Thus, the LED light sources 74 constitute an LED light source group. A mark 70A shows two lead wires (power source line) and 70B shows three lead wires (volume lines) (see FIG. 13). Among these, the lead wire 70A is connected to the printed circuit board 72 at one end thereof, and the other end (apex) is lead to a lead hole (not shown in the drawing) bored at an end part of a side wall 10D that partitions the housing 10 and connected to the battery via a charge plug 85. Furthermore, the lead wire 70B is connected to the printed circuit board 72 at one end thereof and the other end (apex) is connected to the illuminance adjusting volume part 78.

The printed circuit board 72 is formed into an outer shape of a circle and is provided with an insertion hole through which a center shaft 22 is inserted at a center.

The printed circuit board 72 includes two capacitors 75A, 75B, a driving IC (FET) 76, and a variable resistor 77. The variable resistor 77 adjusts a voltage applied to the driving IC (FET) to control a light amount (brightness) of the LED light source 74. That is, a voltage applied to the driving IC (FET) 76 is adjusted by operating a knob (knob nut that makes operate) 79 that turns the illuminance adjusting volume part 78 and an amount of light of the LED light source 74 may be controlled thereby. The capacitors 75A, 75B absorb noise.

The diffused light 300 obtained by making light supplied from the LED light source pass the light diffusion plate is irradiated on a sheet metal surface in the neighborhood of the bit 25. The diffused light 300 is supplied as diffused light that does not generate the shadow due to the center shaft 22 and the bit 25 of the drawing-out tool for sheet metal in a limited small area in the neighborhood of the bit.

The light diffusion plate 90 is formed of a translucent resin member and has an insertion hole through which the center shaft 22 is inserted formed at a center.

The printed circuit board 72 and the light diffusion plate 90 are provided with a screw insertion hole formed at each of the corresponding same positions, and, the printed circuit board and the light diffusion plate are locked to the housing by a locking screw 94 inserted into a screw insertion hole in a correspondingly isolated state.

Housing 10:

In FIG. 1 to FIG. 8, the housing 10 accommodates the illumination unit 70 that illuminates a sheet metal surface. The housing 10 includes the division walls (10C, 10D) formed of the vertical wall 10C and lateral wall (bottom wall) 10D that partition the housing. By the division wall, the housing is partitioned into a space 10A and a power source accommodating part 17.

In the housing 10, the space 10A that can house an energization part body 101 and a spring 24, a first insertion hole 11 through which the center shaft 22 is inserted, a second insertion hole 12 through which a supporting screw 69 for supporting the housing is inserted, a first throughhole 13 for exposing one end of the charging plug 85, a third insertion hole 14 through which a support shaft 58 for supporting a second lever 50 constituting the second operation means 30 inserts, a second throughhole 15 for exposing one end of the illuminance adjusting volume body 78, a missing part 16 for accommodating shoulder parts of arms 43A, 43B formed on the second operation means 30, a power source accommodating part 17 for accommodating the battery 80, and a downward-directed step parts 19 for accommodating the light diffusion plate 90 are formed.

The arms 43A, 43B and the energization part body 10 are integrally formed, and the arms are supported by the leg body 130. In a state where the energization part body is accommodated in the space of the housing, an apex of the supporting screw inserted in the second insertion hole formed in the housing is screwed with a screw hole 104 formed in the energization part body, and, in this state, the other end of the supporting screw stays in the second insertion hole, and the housing is supported by the energization part body.

Thus, the housing 10 is supported by the second operation means 30 supported by the leg body 130.

In the power source accommodating part 17, an opening part 17A that allows insertion and release of the battery (battery for light source) is formed. The opening part is clogged by locking a cover member 18 with a locking screw 18A.

A mark 59 shows an E ring, in a bearing part 54 for supporting the support shaft 58 in a state where the second lever 50 is pivotally supported, the support shaft 58 is fastened, the looseness of the support shaft is prevented (see FIG. 1, FIG. 2, FIG. 4, FIG. 6 and FIG. 8).

The charge plug 85 is a charge plug into which a cord of a charger is inserted for charging when the battery 80 is consumed.

Energization Mechanism 100:

Furthermore, an energization mechanism 100 is incorporated in a drawing-out tool for sheet metal 1.

In FIG. 8, FIG. 18 to FIG. 20, the energization mechanism 100 is formed as an energization mechanism for supplying electric current to the bit 25 weldable to a sheet metal surface arranged at an apex part of the center shaft 22.

The energization mechanism 100 includes the energization part body 101 formed from a conductive member, and the energization part body has a first throughhole 102 for inserting the center shaft 22 at a center as a vertical hole. Furthermore, in a direction orthogonal to a formation direction of the first throughhole, a pair of left and right second throughholes 103A, 103B that are communicated with the first throughhole are formed as lateral holes.

The second throughholes 103A, 103B each are provided with an energization element 105. On a lower part of the energization part body 101, a recess part 101A for accommodating and holding an upper end part of a spring 24 is formed. A mark 104 shows a screw hole formed on a lower part of the second throughhole 103. The supporting screw 69 supports the energization part body 101 in the housing 10. The screw hole 104 is screwed with the (apex of) supporting screw 69 inserted in the insertion hole 12 formed in the housing 10 in a state where the energization part body 101 is housed in a space 10A of the housing. In this state, the other end of the supporting screw 69 stays in the insertion hole 12, and the housing supports the energization part body.

Figure 6:
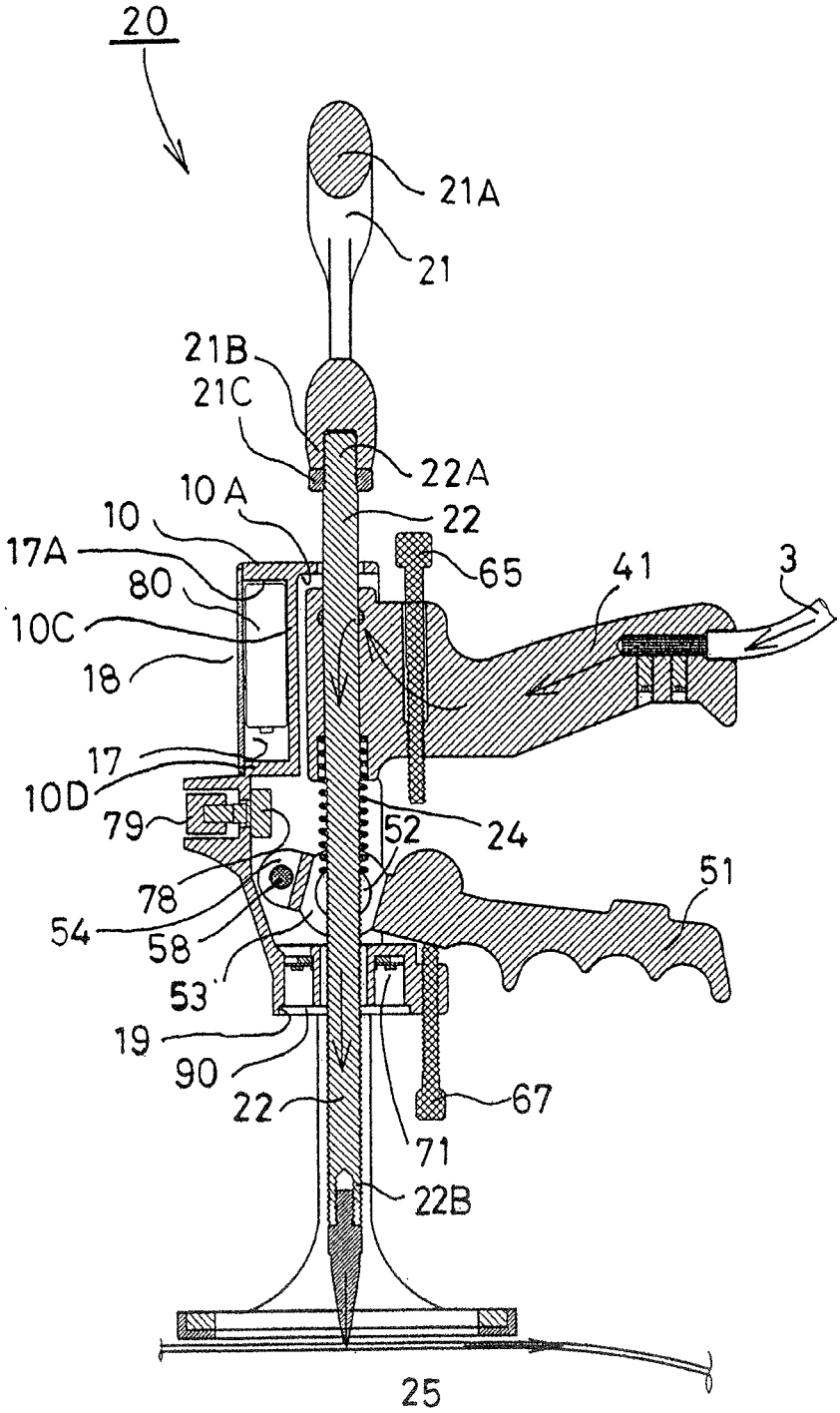
FIG. 6 is a view in which a flow of electric current during energization is drawn in an X-X cross-sectional view shown in FIG. 3.
Figure 7:
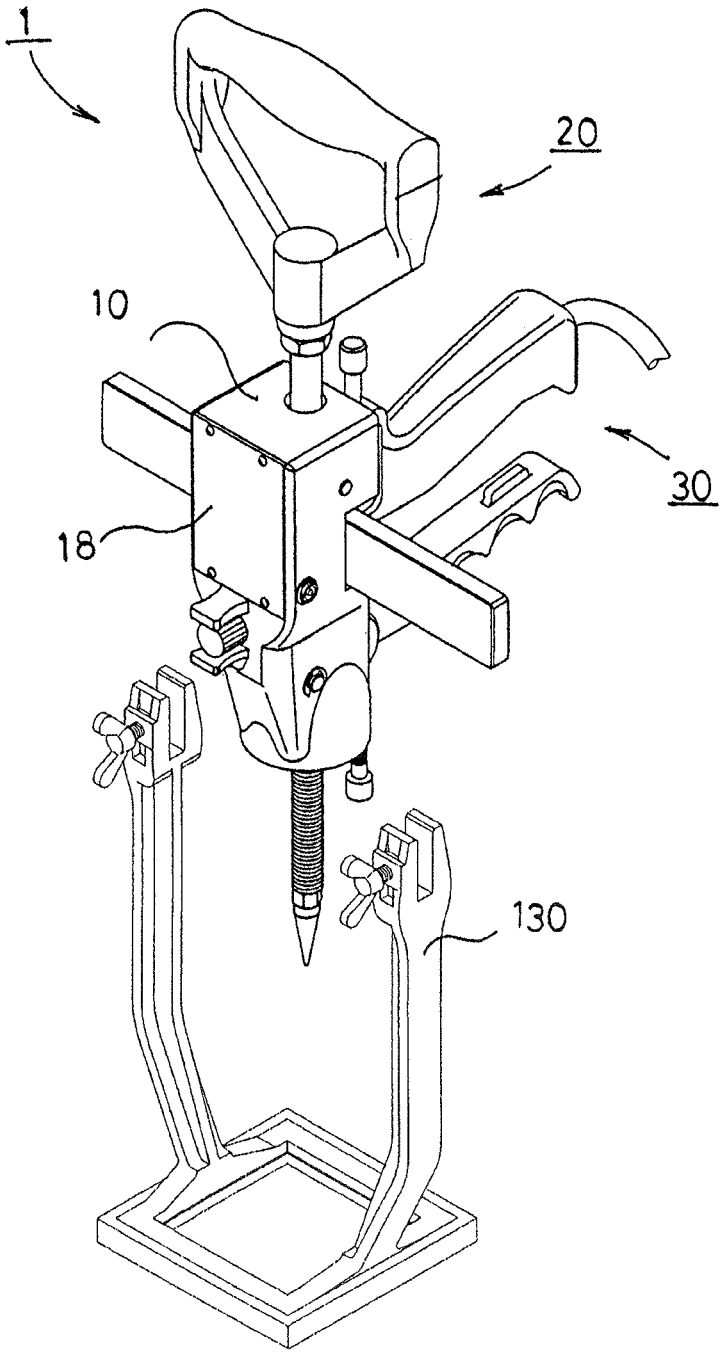
FIG. 7 is a perspective view of a state where a body and a leg body of the drawing-out tool for sheet metal shown in FIG. 1 are separated.
Figure 20:
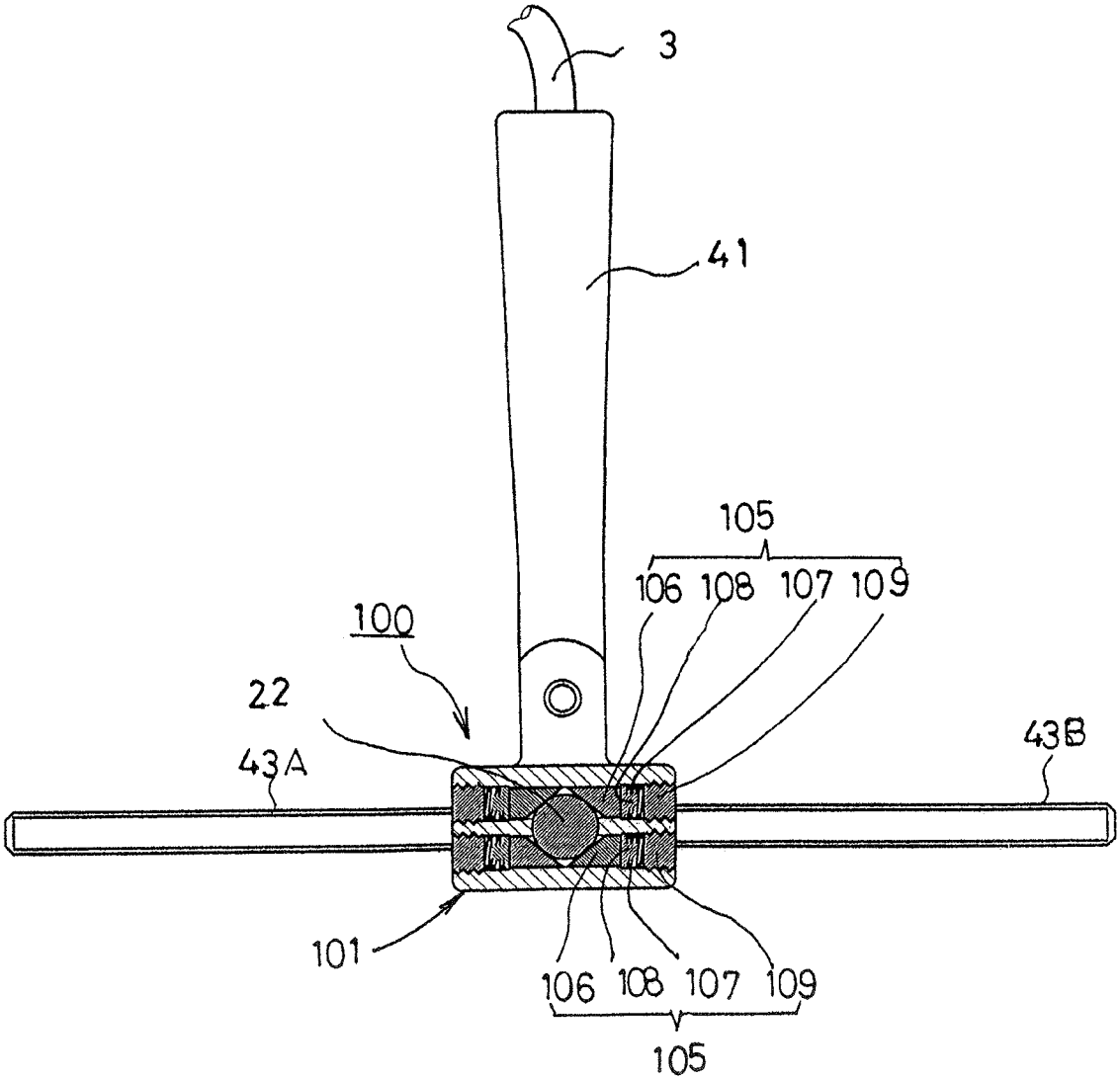
FIG. 20 is a Y-Y cross-section enlarged schematic view of FIG. 18.
Figure 21:
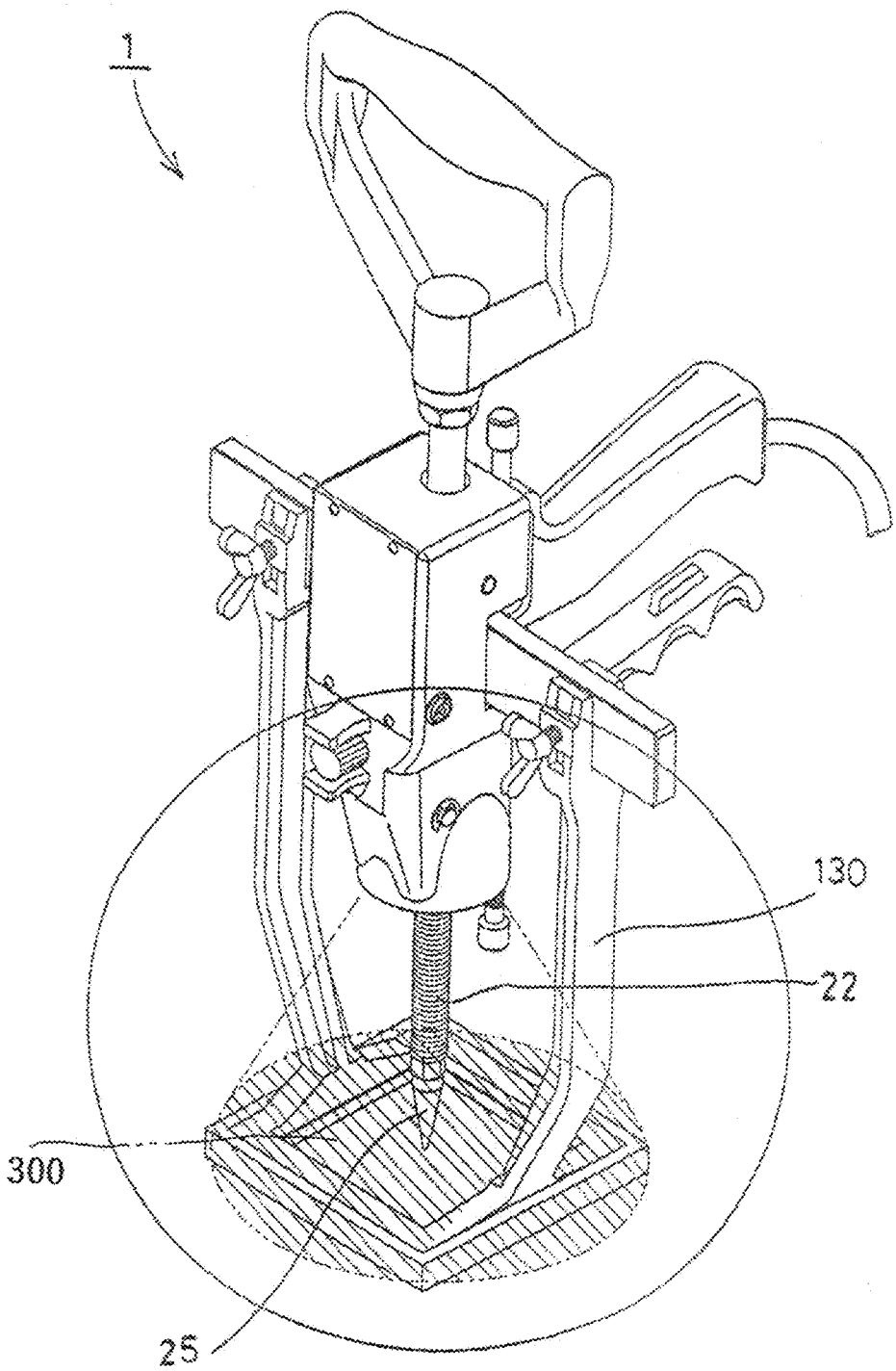
Figure 22:
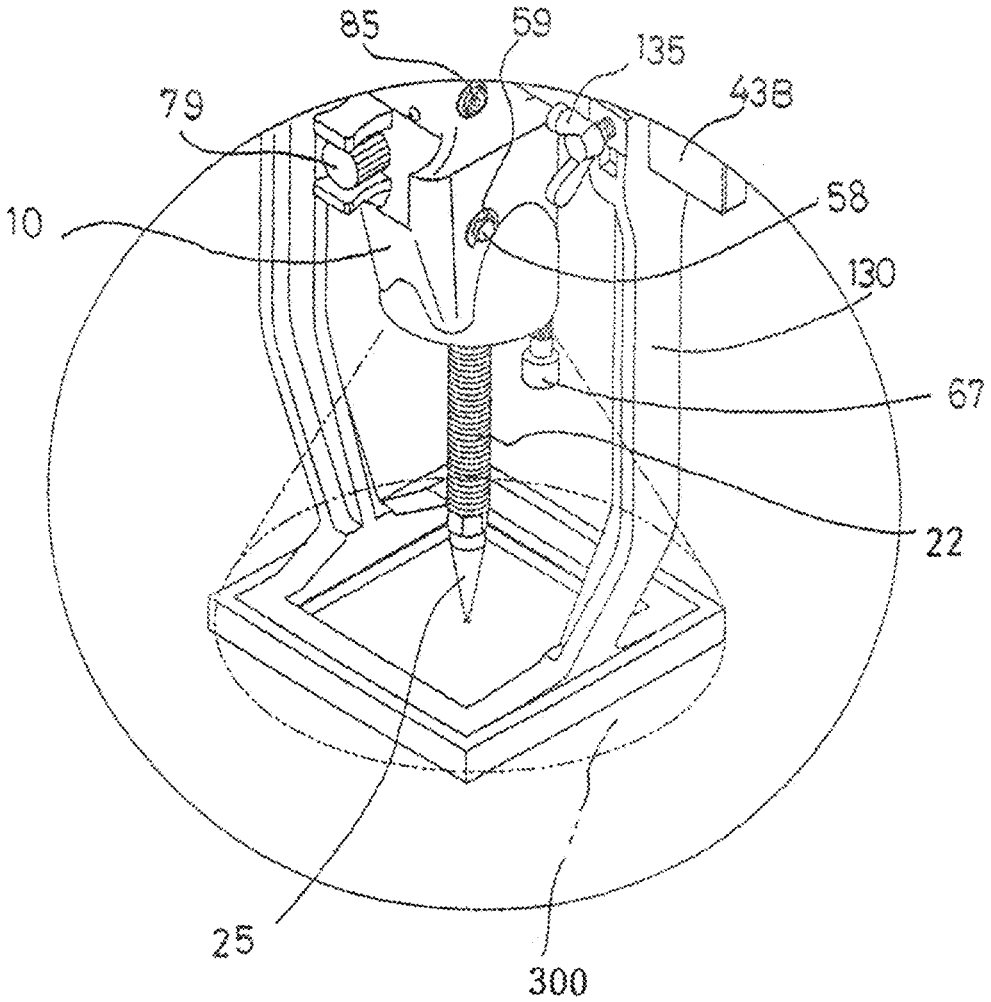
FIG. 22 is an essential part perspective view of a sheet metal surface showing a state where the illumination unit of the drawing-out tool for sheet metal shown in FIG. 1 is turned on and showing a state where a shadow due to a center shaft or a bit is not generated at a position to be subjected to a sheet metal process.
Figure 23:
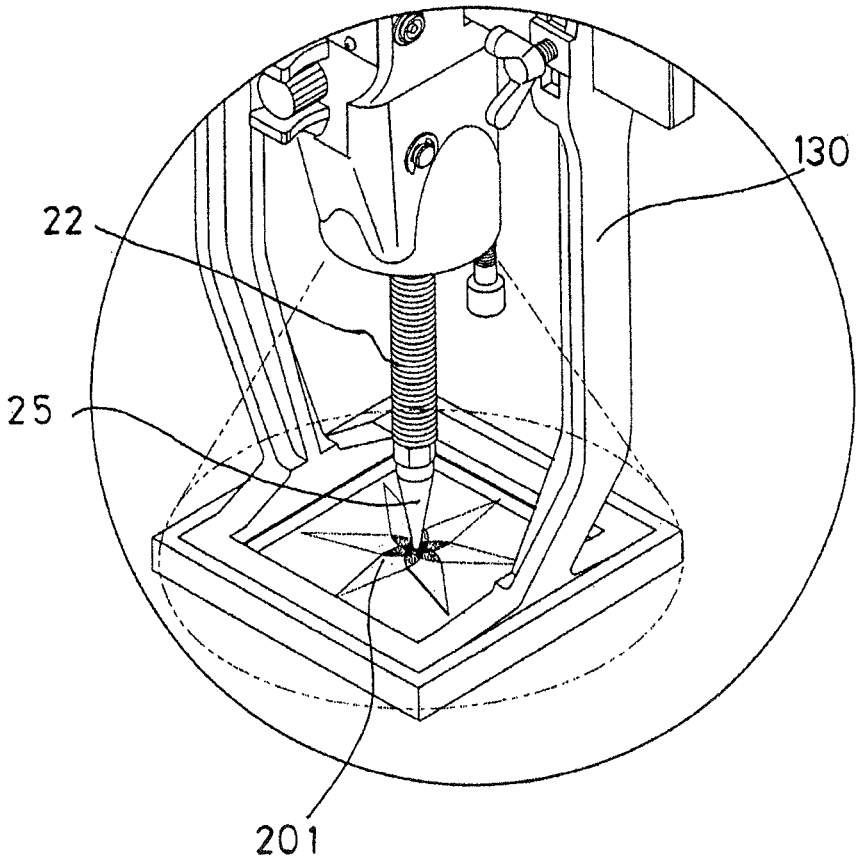
FIG. 23 is an essential part perspective view of a sheet metal surface showing a state where the light diffusion plate is removed from the drawing-out tool for sheet metal shown in FIG. 1 and the illumination unit is turned on, and a state where a shadow due to a center shaft or a bit is generated at a position to be subjected to the sheet metal process.
Figure 24:
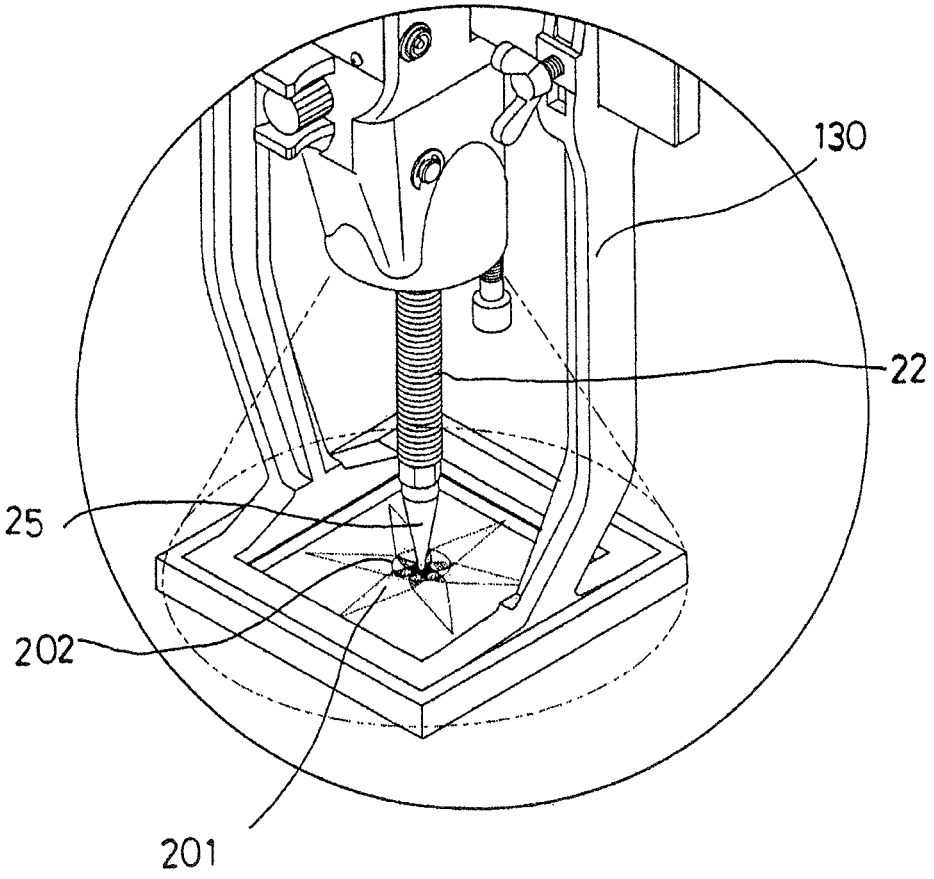
FIG. 24 is an essential part perspective view of a sheet metal surface showing a state where the light diffusion plate is removed from the drawing-out tool for sheet metal shown in FIG. 1 and the illumination unit is turned on, and a state where a shadow due to the center shaft or the bit overlaps with the irregularity on the sheet metal surface to be difficult to see a relief of a surface necessary to be subjected to the sheet metal process.
Figure 25:
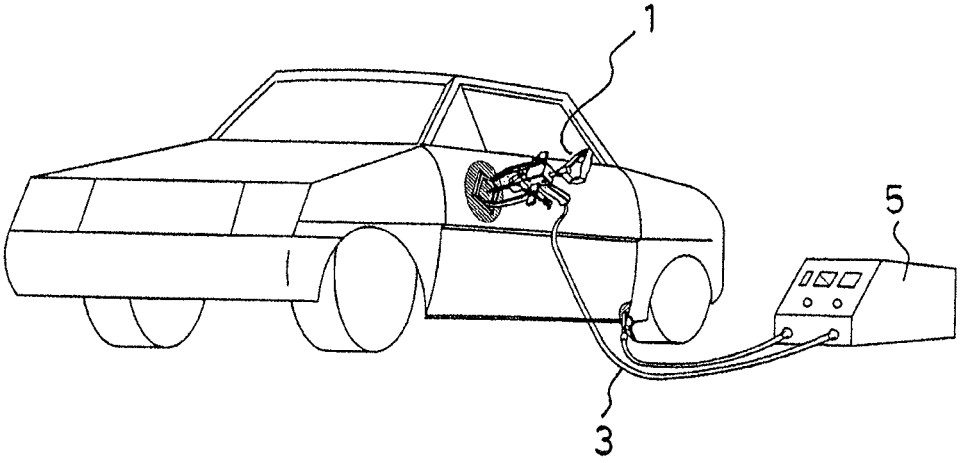
FIG. 25 is a perspective view showing a use state of the drawing-out tool for sheet metal shown in FIG. 1.

The energization element 105 is constituted by including an energization chip 106 that abuts on the center shaft 22, and a coil spring 107 that biases the energization chip in the center shaft direction, and an electric current is supplied to the center shaft via the energization chip to supply electric current to the bit (see FIG. 6, FIG. 20).

The energization chip 106 has an apex surface formed into an elliptical cross-section by obliquely cutting a cylindrical member, and in the energization part body, an apex surface of the energization chip 106 and the center shaft 22 abut on each other by line contact (see FIG. 20).

The second throughhole 103 is formed, as was described above, as the lateral hole for every two points in a horizontal direction of the energization part body (see FIG. 8, FIG. 18, FIG. 19), in a state where the center shaft 22 is inserted in the first throughhole 102, the energization element 105 is arranged to each of the lateral holes, and the energization chips 106 facing via the center shaft 22 are in contact with the center shaft 22 with uniform pressure strength.

A spacer 108 formed of an insulator is interposed between the energization chip and a coil spring, and the energization chip 106 and the coil spring 107 are placed in a non-conductive state. Thus, an electric current does not flow to the coil spring 107, and the coil spring 107 is evaded from being burned by the electric current (the electric current does not flow to the coil spring 109 via the energization chip 106).

The energization element 105 is inserted into the second throughhole 103, and in a state where the energization chip is abutting on the center shaft, the screw 109 is screwed with an opening part of the second throughhole to close the opening part.

Drawing-Out Tool for Sheet Metal 1 in which Illumination Unit 70 is Incorporated:

In FIG. 1 to FIG. 7, the drawing-out tool for sheet metal 1 in which the illumination unit 70 is incorporated is shown. In the drawing-out tool for sheet metal 1, the illumination unit 70 is incorporated in the housing 10 that is arranged at the center of the drawing-out tool for sheet metal 1.

The drawing-out tool for sheet metal 1 includes: the center shaft 22; a first operation means 20 provided with the bit 25 arranged at the apex part of the center shaft and weldable to a sheet metal surface; the second operation means 30 that can be manually operated and is formed to pull-up the first operation means 20; a support member 60 formed to support the first operation means 20; the leg body 130 formed to support the second operation means 30; the housing 10; the illumination unit 70; the energization mechanism 100 for conducting electricity to the bit 25; and an electric power cord 3 for supplying electricity to the energization mechanism 100. The first operation means 20 includes the center shaft 22 and a handle 21 for rotating the center shaft provided to one end of the center shaft 22.

The drawing-out tool for sheet metal 1 includes, as was described above, the housing 10 for accommodating the illumination unit 70 for illuminating a sheet metal surface.

The illumination unit 70 includes: the LED light source 74 incorporated in the housing 10; the battery 80 for supplying electric power to the LED light source; and the light diffusion plate 90 for diffusing light supplied from the LED light source. The LED light source is fixed on the printed circuit board 72. In the housing, the printed circuit board and the light diffusion plate are arranged correspondingly isolated.

The diffused light obtained by making light supplied from the light source pass through the light diffusion plate makes it possible to illuminate a sheet metal surface in the neighborhood of the bit, and in a limited small area in the neighborhood of the bit, the diffused light is supplied as the diffused light that does not generate a shadow due to the center shaft and the bit.

The first operation means 20 includes: the center shaft 22 made of brass; and the handle 21 for rotating the center shaft provided to one end of the center shaft 22, and the bit 25 is provided to an apex part of the center shaft 22.

That is, one end part 22A of the center shaft 22 constituting the first operation means 20 is screwed with a screw hole of a connection part 21B formed by continuing to the handle 21, on the other hand, a female screw part formed to the apex part 22B of the center shaft 22 is screwed with a male screw part provided to a base end part of the bit 25 (see FIG. 6).

A screw part 23 is engraved over from a substantial center to a base end part of the center shaft 22, the screw part 23 is screwed with the support member 60 of the second operation means 30, and the first operation means 20 is rotatably supported by the second operation means 30.

A spring 24 is wound around the center shaft 22. Here, the spring 24 has a spring upper end part located in the recess 101A of the energization part body 101, and a spring lower end part located on a top surface of the support member 60, which are wound around the center shaft 22. The spring 24 biases the second lever 50 downward, pulls-up the second lever 50 while resisting against the resilient force of the spring to execute the sheet metal process.

The second operation means 30 is constituted by containing a main lever 40 and a second lever 50, and the spring 24 interposed between the main lever 40 and the second lever 50.

The main lever 40 includes: a handle part 41 formed by coating an insulation member; and a pair of the right and left arms 43A, 43B extended in a direction orthogonal to an arrangement direction of the handle part 41 and supported by the leg body 130. One end of a power source cord (terminal cord) 3 is fixed to a back end of the main lever 40, and the other end of the power source cord is connected to a welder 5.

A flow of an electric current during a sheet metal surface correction operation is shown in FIG. 6. During energization, the electric current flows a path of the welder 5→power source cord 3→main lever 40→energization part body 101→energization chip 106→center shaft 22→bit 25 to energize.

The second lever 50 includes: in the same manner as the handle part 41, a handle part 51 formed by coating an insulation member; a hollow part 52 formed on an apex part side of the handle part 51; and a bearing part 54 for supporting the support shaft 58 for pivotally supporting the second lever 50.

The second lever 50 includes the support member 60 for supporting the first operation means 20. In the support member 60, a center throughhole (penetration part) 62 is formed, in the center throughhole 62 a female screw part is formed, and the male screw part 23 of the center shaft 22 is screwed with the female crew part.

The support member 60 is accommodated in the hollow part 52, and both end parts of the support member 60 are supported by frames 53 on both sides of the hollow part 52. Thus, a female screw part of the throughhole (penetrating part) 62 of the support member 60 and a male screw part 23 of the center shaft 22 are screwed, and the first operation means 20 is rotatably supported by the second operation means 30.

Figure 8:
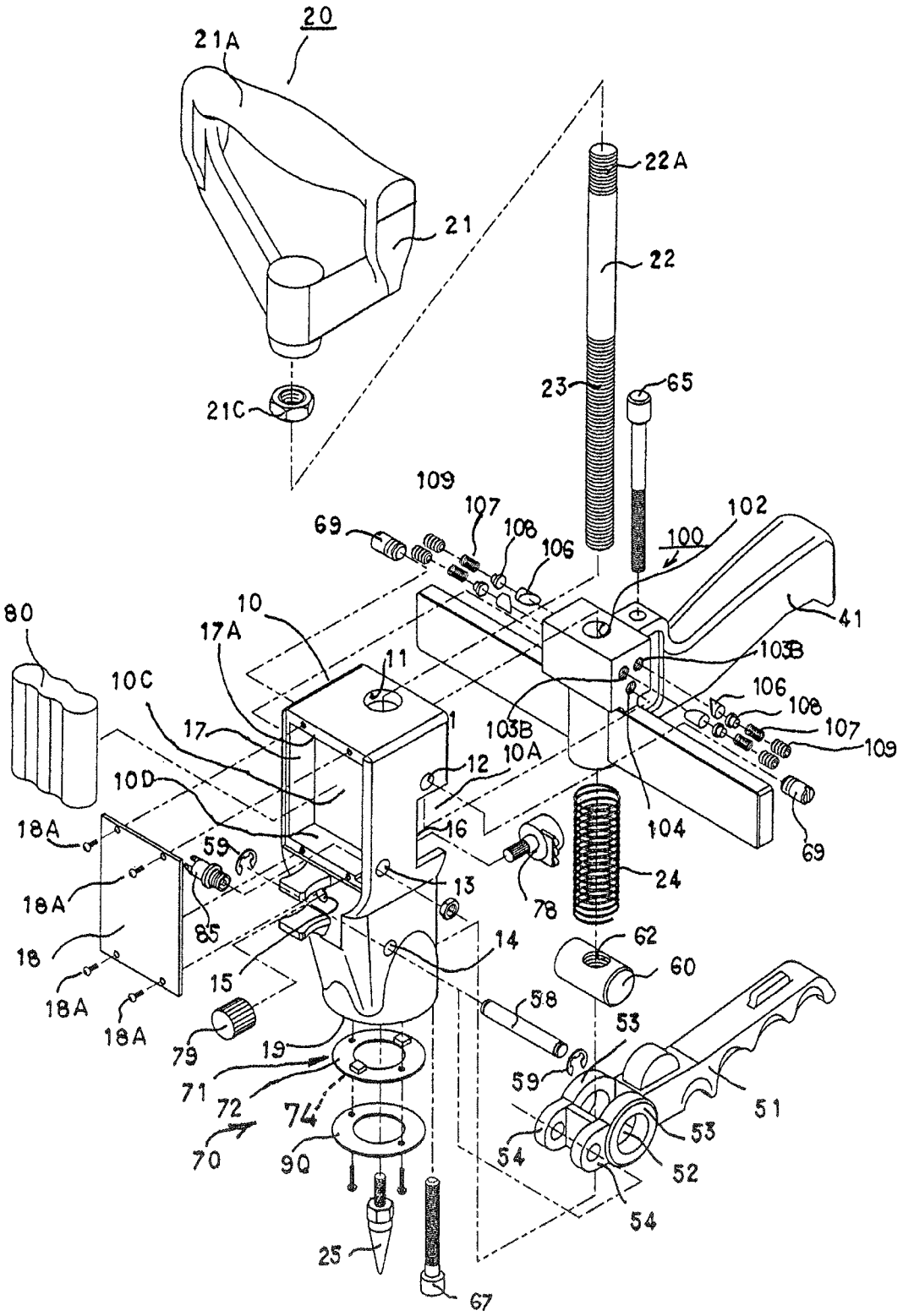
FIG. 8 is an exploded perspective view showing constituent components of the body of the drawing-out tool for sheet metal shown in FIG. 1.
Figure 9:
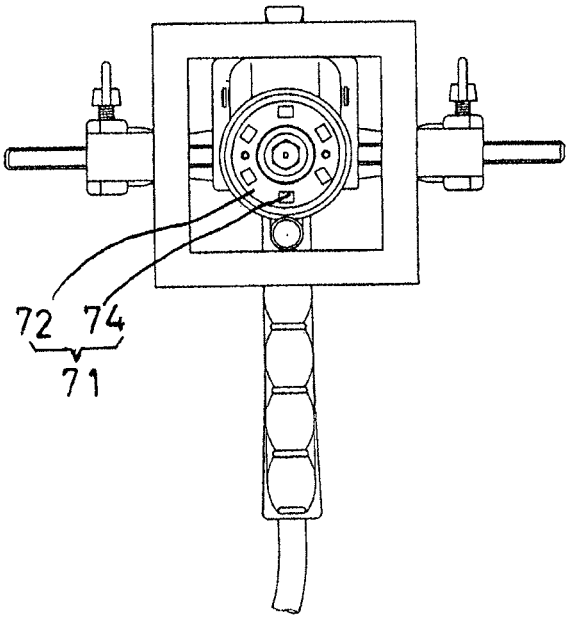
FIG. 9 is a bottom view of a state where a light diffusion plate of the drawing-out tool for sheet metal shown in FIG. 1 is removed.
Figure 10:
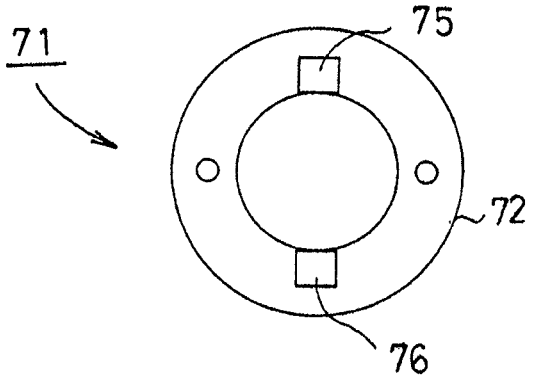
FIG. 10 is a front view of a printed circuit board in which LED light sources or the like are embedded.

The main lever 40, the arms 43A, 43B, and the energization part body 101 are integrally formed (see FIG. 8).

Thus, the drawing-out tool for sheet metal includes: the center shaft; a first operation means provided with a bit arranged to an apex part of the center shaft and weldable to a sheet metal surface; a support member formed for supporting the first operation means; a second operation means formed for pulling-up the first operation means; a leg body formed for supporting the second operation means; a power source cord for supplying electricity to the energization mechanism; and the energization mechanism for conducting an electric current to the bit, in which the first operation means includes: the center shaft; and a handle for rotating the center shaft provided at one end of the center shaft.

Furthermore, the drawing-out tool for sheet metal includes a housing for accommodating an illumination unit for illuminating a sheet metal surface, the illumination unit includes: a light source incorporated in the housing; a power source for light source for supplying electric power to the light source; and the light diffusion plate for diffusing the light supplied from the light source, the printed circuit board and the light diffusion plate are arranged correspondingly isolated in the housing, the diffused light obtained by making the light supplied from the light source pass the light diffusion plate is made possible to be illuminated on the sheet metal surface in the neighborhood of the bit, and the diffused light is supplied as the diffused light that does not generate a shadow due to the center shaft and bit in the limited small area in the neighborhood of the bit.

A mark 21C shows a lock nut for preventing the handle 21 and the shaft 22 from loosening, a mark 65 shows a pulling-up margin adjusting bolt for adjusting the margin for adjusting the pulling-up margin when the irregularity of the sheet metal surface is pulled-up, and a mark 67 shows a grip range adjusting bolt that enables to adjust a grip range when an operator grips the operation means with a hand to a position where the second lever 50 is readily gripped. A mark 135 shows a butterfly nut that is used to connect and fix the arms 43A, 43B and the leg body by inserting the arms in a receiving part of the leg body 130.

What is claimed is:

1. A drawing-out tool for sheet metal comprising:

a center shaft;

a first operation member provided with a bit arranged to an apex part of said center shaft and weldable to a sheet metal surface;

a second operation member including a pair of arms for pulling-up said first operation member;

an energization mechanism including an energization part body formed from a conductive member which supplies electric current to said bit;

a leg body for supporting said second operation member;

a housing for accommodating an illumination unit; and said illumination unit for illuminating said sheet metal surface accommodated in said housing;

wherein said housing includes a space for accommodating said energization mechanism, and a power source accommodating part for accommodating a power source for a light source for constituting said illumination unit;

wherein said illumination unit includes said light source incorporated in said housing, said power source for said light source for supplying electric power to said light source, and a light diffusion plate for a diffusing light supplied from said light source;

wherein said light source is fixed on a printed circuit board;

wherein said printed circuit board and said light diffusion plate are arranged correspondingly isolated; and wherein said light source is constituted from LED light sources, said LED light sources are fixed on said printed circuit board arranged in said housing, and said LED light sources are constituted as an LED light source group in which a plurality of said LED light sources are arranged spaced equidistant apart on said printed circuit board.

2. A drawing-out tool for sheet metal comprising:

a center shaft;

a first operation member provided with a bit arranged to an apex part of said center shaft and weldable to a sheet metal surface;

a second operation member including a pair of arms for pulling-up said first operation member;

a support member for supporting said first operation member;

an energization mechanism including an energization part body formed from a conductive member which supplies electric current to said bit;

a leg body for supporting said second operation member;

a power source cord for supplying electricity to said energization mechanism;

a housing for accommodating an illumination unit; and said illumination unit for illuminating said sheet metal surface accommodated in said housing;

wherein said housing includes a space for accommodating said energization mechanism, and a power source accommodating part for accommodating a power source for a light source for constituting said illumination unit;

wherein said illumination unit includes said light source incorporated in said housing, said power source for said light source for supplying electric power to said light source, and a light diffusion plate for a diffusing light supplied from said light source;

wherein said light source is fixed on a printed circuit board;

wherein said printed circuit board and said light diffusion plate are arranged correspondingly isolated; and wherein said light source is constituted from LED light sources, said LED light sources are fixed on said printed circuit board arranged in said housing, and said LED light sources are constituted as an LED light source group in which a plurality of said LED light sources are arranged spaced equidistant apart on said printed circuit board.

3. The drawing-out tool for sheet metal according to claim 1, wherein said power source accommodating part has an opening that makes it possible to insert and release said power source as said light source, and said opening is covered with a cover member.

4. The drawing-out tool for sheet metal according to claim 3, wherein a base end part of said second operation member is accommodated in said space of said housing.

5. The drawing-out tool for sheet metal according to claim 4, wherein said illumination unit is formed such that an illuminance adjusting volume part is provided, and a light amount of said light source is adjustable by said illuminance adjusting volume part.

6. The drawing-out tool for sheet metal according to claim 5, wherein said housing is supported by said second operation member supported by said leg body.

7. The drawing-out tool for sheet metal according to claim 6, wherein said housing comprises:

said space for accommodating an energization part body;

a first insertion hole through which said center shaft is inserted;

a second insertion hole through which a supporting screw for supporting said housing is inserted;

a third insertion hole through which a support shaft for supporting a second lever constituting said second operation member is inserted;

a throughhole for exposing one end of said illuminance adjusting volume part;

said power source accommodating part; and a step part directed downward for accommodating said light diffusion plate.

8. The drawing-out tool for sheet metal according to claim 7, wherein said pair of arms are extended right and left, wherein said arms and said energization part body are integrally formed, said arms are supported by said leg body, in a state where said energization part body is housed in said space of said housing, an apex of a supporting screw inserted in said second insertion hole formed in said housing screws with a screw hole formed in said energization part body, in this state, other end of said supporting screw stays in said second insertion hole, and said housing is supported by said energization part body.

9. A drawing-out tool for sheet metal comprising:

a center shaft;

a first operation member provided with a bit arranged to an apex part of said center shaft and weldable to a sheet metal surface;

a second operation member including a pair of arms for pulling-up said first operation member;

a support member for supporting said first operation member;

an energization mechanism including an energization part body formed from a conductive member which supplies electric current to said bit;

a leg body for supporting said second operation member;

a housing for accommodating an illumination unit; and said illumination unit for illuminating said sheet metal surface accommodated in said housing;

wherein said housing includes a space for accommodating said energization mechanism, and a power source accommodating part for accommodating a power source for a light source for constituting said illumination unit;

wherein said illumination unit includes said light source incorporated in said housing, said power source for said light source for supplying electric power to said light source, and a light diffusion plate for a diffusing light supplied from said light source;

wherein said light source is fixed on a printed circuit board;

wherein said printed circuit board and said light diffusion plate are arranged correspondingly isolated; and wherein said light source is constituted from LED light sources, said LED light sources are fixed on said printed circuit board arranged in said housing, and said LED light sources are constituted as an LED light source group in which a plurality of said LED light sources are arranged spaced equidistant apart on said printed circuit board.

10. The drawing-out tool for sheet metal according to any one of claims 1, 9, or 2 in which said illumination unit is formed such that an illuminance adjusting volume part is provided, and a light amount of said illumination unit is adjustable by said illuminance adjusting volume part.

* * * * *